United States Patent [19]

Klein et al.

[11] Patent Number: 4,936,786

[45] Date of Patent: Jun. 26, 1990

[54] AUTOMATED CONNECTION FOR A VEHICLE RADIO

[75] Inventors: Frank H. Klein; Steven F. Selby, both of Huntsville, Ala.

[73] Assignee: Acustar, Inc., Troy, Mich.

[21] Appl. No.: 348,328

[22] Filed: May 4, 1989

[51] Int. Cl.[5] ..... H01R 9/09

[52] U.S. Cl. ..... 439/76; 439/78; 439/80; 439/248; 29/836; 29/840

[58] Field of Search ..... 29/832, 834, 836, 840; 439/76, 78, 79, 80, 248, 547

[56] References Cited

U.S. PATENT DOCUMENTS 4,374,603 2/1983 Fukunaga et al. ..... 439/248

*Primary Examiner*—P. Austin Bradley

*Attorney, Agent, or Firm*—Edward A. Craig

[57] ABSTRACT

Accordingly, the present invention is an automated connection for a vehicle radio. The vehicle radio includes a housing having a top plate, bottom plate, front and rear plates and side plates. A printed circuit board is disposed within the housing and secured to the bottom plate. At least one electrical female connector is secured to the printed circuit board. The front plate has a plurality of apertures corresponding to the location of the female connector. A male connector electrically connected to an external object is secured to the housing and adapted to engage the female connector to allow electrical connection between the external object and the printed circuit board when the front plate is assembled to the housing.

11 Claims, 2 Drawing Sheets

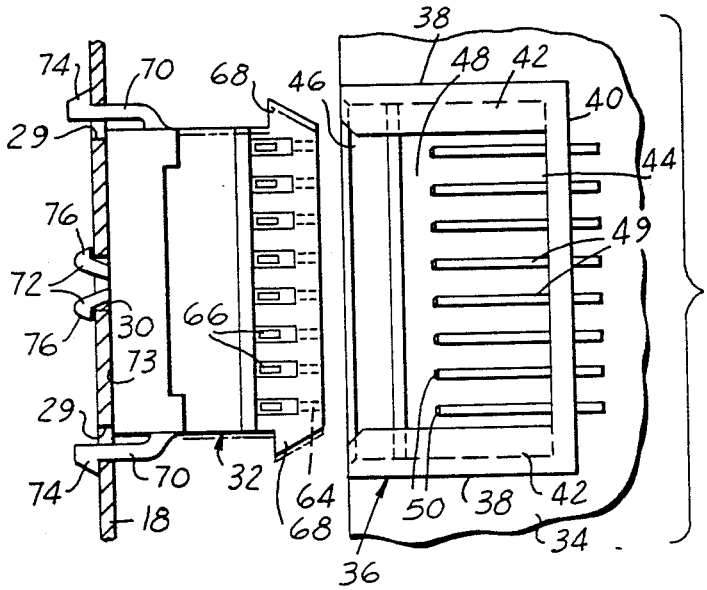
FIG.3
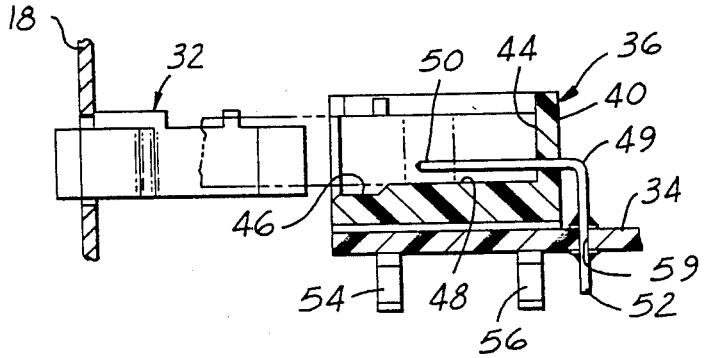
FIG.4
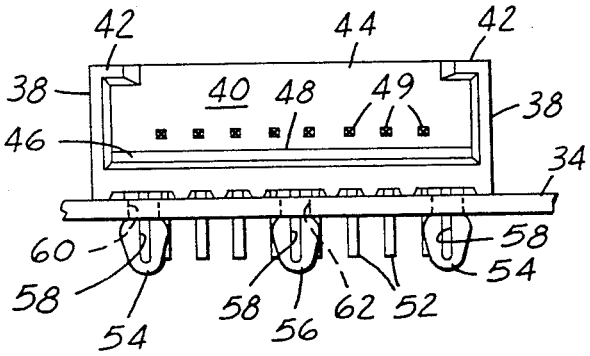
FIG.5
FIG.6
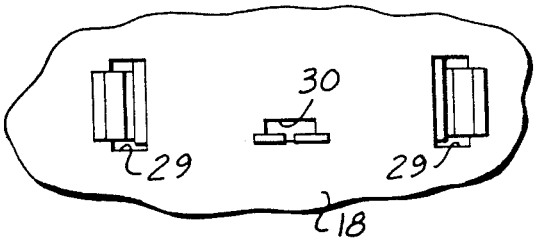

AUTOMATED CONNECTION FOR A VEHICLE RADIO

BACKGROUND OF THE INVENTION

1. Field of the Invention

The present invention relates generally to a vehicle radio, and more particularly to an automated connection for a vehicle radio.

2. Description of Related Art

A radio for a vehicle such as an automobile includes at least one cable assembly for electrical internal connection between an object and the radio. Typically, these cable assemblies are mated by hand or manually by a person for interconnection within the radio. However, this is not suitable for use in an automated assembly environment.

It is, therefore, an object of the present invention to provide a connection for use in an automated assembly environment.

It is another object of the present invention to provide an automated connection which eliminates any manual alignment or mating by a person.

SUMMARY OF THE INVENTION

Accordingly, the present invention is an automated connection for a vehicle radio. The vehicle radio includes a housing having a top plate, bottom plate, front and rear plates and side plates. A printed circuit board is disposed within the housing and secured to the bottom plate. At least one electrical female connector is secured to the printed circuit board. The front plate has a plurality of apertures corresponding to the female connector. A male connector electrically connected to an external object is secured to the housing. The male connector is adapted to engage the female connector to allow electrical connection between an external object and the printed circuit board when the front plate is assembled to the housing.

The present invention also provides a method of assembling a vehicle radio including a housing having a top plate, bottom plate, front and rear plates and side plates. The method includes the steps of securing an electrical female connector to a printed circuit board and placing them within the housing. The method also includes securing the printed circuit board to the housing and securing an electrical male connector electrically connected to an external object to the front plate of the housing for engagement with the female connector to allow electrical connection between the external object and the printed circuit board when the front plate is assembled to the housing.

One advantage of the present invention is that the connection allows self-alignment and mates without any manual or hand alignments. Another advantage of the present invention is that the connection can be used in an automated assembly environment.

Other advantages of the present invention will be readily appreciated as the same becomes better understood after reading the following description in connection with the accompanying drawings.

BRIEF DESCRIPTION OF THE DRAWINGS

FIG. 3 is an exploded plan view with a portion broken away of the partially assembled vehicle radio of FIG. 2.

FIG. 4 is a sectional view taken along line 4—4 of FIG. 3.

FIG. 5 is an elevational view of a header shown in FIG. 3.

FIG. 6 is an elevational view of a portion shown in FIGS. 1 and 2.

DESCRIPTION OF THE PREFERRED EMBODIMENT

Figure 1:
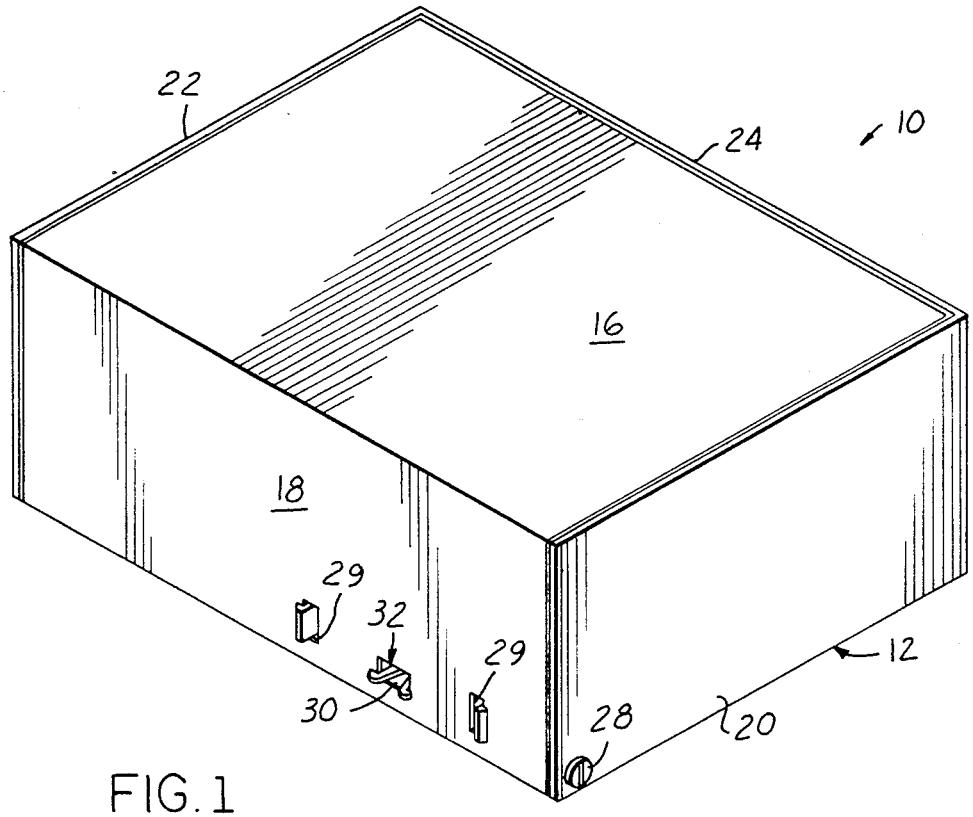
FIG. 1 is a perspective view of a vehicle radio constructed in accordance with the principles of the present invention.
Figure 2:
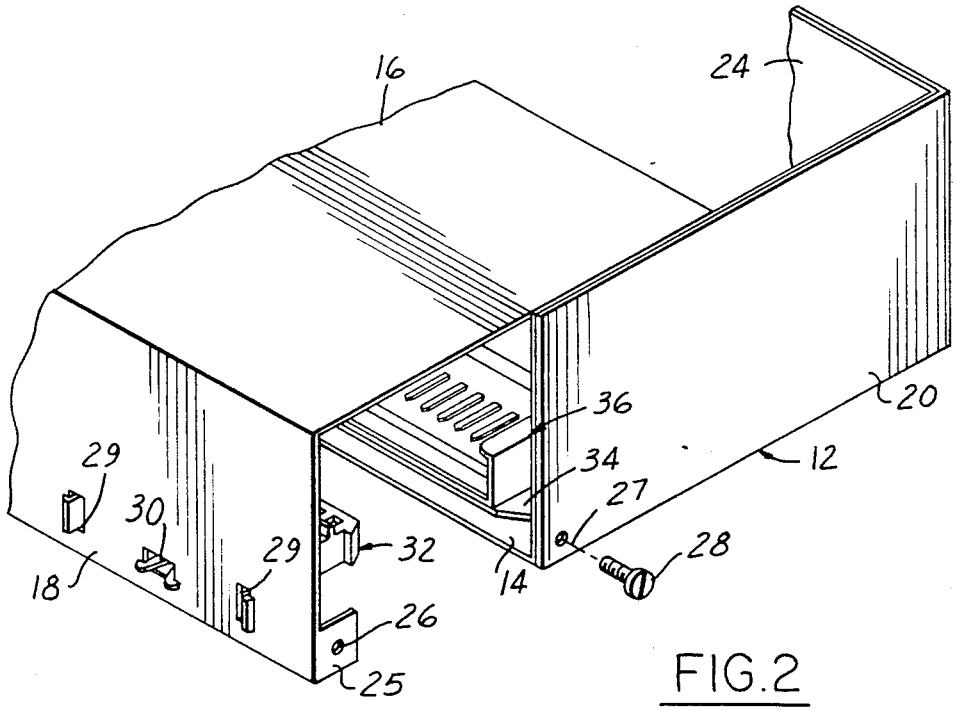
FIG. 2 is a partial exploded perspective view of the partially assembled vehicle radio of FIG. 1.

Referring to FIG. 1, a partially assembled radio 10 for a vehicle such as an automobile is shown. The partially assembled radio 10 includes a generally rectangular housing, generally indicated at 12. The housing 12 comprises a generally rectangular and planar bottom plate 14 (FIG. 2), a top plate 16, and a front plate 18. Preferably, the top plate 16 and front plate 18 are integral to for a generally "L" shaped member. The housing 12 further comprises a generally rectangular and planar pair of side plates 20 and 22 and a rear plate 24. Preferably, the side plates 20, 22 and rear plate 24 are integral to form a generally "U" shaped member forming three sides of the housing 12. The front plate 18 includes a longitudinally extending flange 25 at the lateral edges thereof adapted to abut an inner surface of the side plates 20 and 22. The flange 25 includes an aperture 26 extending through it. The side plates 20 and 22 have a corresponding aperture 27 extending through them. A fastener such as a metal screw 28 extends through the apertures 26 and 27 to secure the front plate 18 to the side plates 20 and 22. The bottom and top plates 14 and 16 are secured to the side plates 20, 22 and rear plate 24 by means such as metal screws 28. It should be appreciated that the plates 14, 16, 20, 22 and 24 include suitable flanges and apertures for allowing the plates to be secured together.

Referring to FIGS. 1 through 3 and 6, the front plate 18 includes a pair of laterally spaced and generally rectangular and vertical extending first apertures 29. The front plate 18 also includes a generally rectangular and horizontally second extending aperture 30 spaced laterally between the first apertures 29. The first and second apertures 29 and 30, respectively, are adapted to receive a male connector, generally indicated at 32, to be described.

Referring to FIGS. 2 through 5, the partially assembled radio 10 includes a printed circuit (PC) board 34 and a female electrical connector or header, generally indicated at 36, connected to the PC board 34. The header 36 is generally rectangular in shape and has upwardly or vertically extending and laterally spaced side walls 38 and a rear wall 40 interconnecting the side walls 38. The side walls 38 include a laterally extending upper wall 42 at the upper ends thereof. The walls 38 and 40 form a generally rectangular cavity 44. The header 36 also has a bottom wall 46 having a raised or stepped portion 48.

The header 36 includes a plurality of laterally spaced and generally "L" shaped circuit projections or terminals 49. The terminals 49 have a first end 50 extending longitudinally through the rear wall 40 into the cavity 44 and a second end 52 extending outwardly and through the rear wall 40 and downwardly.

The header 36 also includes a pair of laterally spaced and outwardly extending first locking projections 54. The header 36 also includes a second locking projection 56 spaced longitudinally and laterally between the first locking projections 54 near the rear wall 40. The locking projections 54 and 56 include a generally "V" shaped free end and a longitudinally extending slot 58 partially along the length thereof to allow the lateral sides to flex or deflect together for a function to be described. Preferably, the header 36 is made of a plastic material such as glass filled polyester and the terminals 49 are made of a metal material such as brass coated with tin-copper.

The PC board 34 is generally a rectangular planar plate having printed circuits (not shown) for electrical connection to various electrical components (not shown). The PC board 34 includes a first row of terminal apertures 59 laterally spaced to receive the corresponding circuit terminals 49. The PC board 34 also includes a second and third row of locking apertures 60 and 62 laterally spaced from the first row. The second row comprises a pair of laterally spaced locking apertures 60 and the third row comprises a single locking aperture 62 to receive the corresponding locking projections 54 and 56, respectively. The locking apertures 60 and 62 have a diameter greater than the terminal apertures 59 but less than the width of the free end of the locking projections 54 and 56.

During assembly, the header 36 is moved toward the PC board 34 until the terminals 49 and locking projections 54 and 56 are disposed in the first, second and third row of apertures 59, 60 and 62, respectively. The free end of the locking projections 54 and 56 flex together to fit within the corresponding locking apertures 60 and 62 and resiliently return to their original width after passing therethrough to secure the header 36 to the PC board 34. The terminals 49 are then secured to the PC board 34 by means such as soldering. The PC board 34 with the attached header 36 are then placed inside the housing 12 along the "z" or vertical axis. The bottom plate 14 includes a plurality of apertures (not shown) extending through it and form a tab (not shown) extending into the aperture and the housing 12. The PC board 34 abuts or contacts the tabs and is then secured to the bottom plate 14 by means such as soldering of the PC board 34 to the tabs. It should be appreciated that the PC board 34 is elevated a distance such as five millimeters (5 mm) above the bottom plate 14.

The male connector 32 is an interface for mating between an external object (not shown) and the header 36. The male connector 32 is generally rectangular in shape and has a plurality of laterally spaced apertures 64 extending longitudinally through it to receive the first end 50 of the circuit terminals 49. The male connector 32 includes a tubular and metallic terminal receiver 66 in each aperture for mating with the first end 50 of the circuit terminals 49 and for attachment to a wire leading to an external device or object. The male connector 32 also includes a pair of laterally spaced guide members 68, one for each side thereof. The guide members 68 are triangular in shape for engaging the inner surface of the side walls 38 of the header 36.

The male connector 32 further includes a pair of first locking tabs 70, one for each side, and a pair of second locking tabs 72 at a front surface 73 thereof for removably securing the male connector 32 to the front plate 18 of the housing 12. The first locking tab 70 is laterally spaced from the side of the male connector 32 and extends longitudinally and outwardly from one end connected to the side of the male connector 32. The first locking tab 70 has a triangular shaped portion 74 at the free end for engaging the housing 12. The second locking tabs 72 extend longitudinally outwardly in a general "V" shape from the front surface 73 of the male connector 32. The second locking tabs 72 have a triangular shaped portion 76 at the free end for engaging the housing 12. Preferably, the male connector 32 is made of a plastic material such as nylon 6/6.

During assembly, the male connector 32 is moved toward the front plate 18 to dispose the locking tabs 70 and 72 is the apertures 29 and 30, respectively. The portions 74 and 76 engage the front plate 18 and are flexed laterally to fit within the corresponding apertures 29 and 30 and resiliently return to their original width or configuration after passing therethrough to secure the male connector 32 to the front plate 18 of the housing 12.

The present invention also provides a method of assembly for the partially assembled radio 10. During assembly of the partially assembled radio 10, the header 36 is placed on the PC board 34 and secured thereto as previously described. The PC board 34 and attached header 36 are placed on the tabs of the bottom plate 14 and secured thereto by soldering of the PC board 34 to the tabs. The bottom plate 14 is slid into the housing 12 formed by the side and rear plates 16, 18 and 20, respectively, and secured together by the screws 28. The male connector 32 is inserted into the apertures 29 and 30 of the front plate 18 as previously described. The guide members 50 engage the inner surface of the side walls 88 of the header 36 and the lower rear corner of the male connector 32 engages the stepped portion 48 such that the circuit terminals 49 slide within the apertures 64 of the male connector 32 and the first end 50 engages the terminal receivers 66. The partially assembled radio 10 may be disassembled by removing the screws 28, placing the bottom plate 14 on a planar surface and pulling or sliding the front plate 18 from the remainder of the housing 12. It should be appreciated that the PC board 30 may then be repaired with the male connector 32 still attached to the front plate 18. The method may then be reversed for reassembly.

The present invention has been described in an illustrative manner. It is to be understood that the terminology which has been used is intended to be in the nature of words of description rather than of limitation.

Obviously, many modifications and variations of the present invention are possible in light of the above teachings. Therefore, within the scope of the appended claims, the present invention may be practiced otherwise than as specifically described.

What is claimed is:

1. An automated connection for a vehicle radio including a housing having a top plate, bottom plate, rear plate, front plate and side plates, comprising:

a printed circuit board, disposed within the housing and secured to the bottom plate;

at least one electrical female connector secured to said printed circuit board;

the front plate having a plurality of apertures corresponding to the location of said female connector; and an electrical male connector electrically connected to an external object and secured to the housing and adapted to engage said female connector to allow electrical connection between the external object and said printed circuit board when the front plate is assembled to the housing.

2. The automated connection as set forth in claim 1 wherein said female connector has a plurality of circuit terminals, said printed circuit board having a plurality of circuit apertures, said circuit terminals being disposed within said circuit apertures and soldered therein.

3. The automed connection as set forth in claim 2 wherein said female connector has a plurality of outwardly extending locking projections, said printed circuit board having corresponding locking apertures, said locking projections being removable disposed within said locking apertures.

4. The automated connection as set forth in claim 3 wherein said male connector includes a pair of laterally spaced locking tabs with an enlarged portion at a free end thereof for deflecting inward when engaging the front plate to allow said male connector to engage the front plate through the apertures and returning to an undeflected position when moved past the front plate to prevent removal of said male connector from the front plate.

5. A partially assembled vehicle radio comprising:

a housing having a top plate, bottom plate, rear and front plate and side plates;

a printed circuit board disposed within said housing and secured to said bottom plate;

at least one electrical female connector secured to said printed circuit board, said female connector has a plurality of circuit terminals, said printed circuit board having a plurality of circuit apertures, said circuit terminals being disposed within said circuit apertures and soldered therein;

wherein said female connector has a plurality of outwardly extending locking projections, said printed circuit board having corresponding locking apertures, said locking projections being removable disposed within said locking apertures;

said front plate having a plurality of apertures corresponding to the location of said female connector; and an electrical male connector electrically connected to an external object, including a pair of laterally spaced locking tabs with an enlarged portion at a free end thereof for deflecting inward when engaging said front plate to allow said male connector to engage said front plate through said apertures and returning to an undeflected position when moved past said apertures to prevent removal of said male connector from said front plate to allow electrical connection between the external object and said printed circuit board.

6. A method of partially assembling a vehicle radio including a housing having a top plate, bottom plate, front and rear plates, and side plates, said method comprising the steps of:

securing an electrical female connector to a printed circuit board;

placing the printed circuit board and female connector within the housing;

securing the printed circuit board to the housing; and securing an electrical male connector electrically connected to an external object to the front plate of the housing for engagement with the female connector to allow electrical connection between the external object and the printed circuit board when the front plate is assembled to the housing.

7. A method as set forth in claim 6 wherein said step of securing the female connector to the printed circuit board comprises soldering circuit terminals of the female connector to the printed circuit board.

8. A method as set forth in claim 7 wherein said step of placing the printed circuit board within the housing comprises disposing the printed circuit board within the housing adjacent the bottom plate to elevate the printed circuit board above the bottom plate.

9. A method as set forth in claim 8 wherein said step of securing the printed circuit board to the housing comprises soldering the printed circuit board to the bottom plate.

10. A method as set forth in claim 9 wherein said step of securing the male connector to the front plate of the housing comprises moving the male connector toward apertures formed in the front plate, deflecting locking tabs on the male connector inward, and returning the locking tabs to their original undeflected position to prevent removal of the male connector from the housing.

11. A method of partially assembling a vehicle radio including a housing having a top plate, bottom plate, front and rear plate and side plates, said method comprising the steps of:

securing an electrical female connector to a printed circuit board by soldering circuit terminals of the female connector to the printed circuit board;

placing the printed circuit board and female connector within the housing;

soldering the printed circuit board to the bottom plate; and securing a male connector electrically connected to an external object to the front plate by moving locking tabs of the male connector within apertures formed in the front plate, deflecting locking tabs on the male connector inward, returning the locking tabs to their original undeflected position to prevent removal of the male connector from the front plate, and moving the front plate toward the rear plate and engaging the male connector with the female connector to allow electrical connection between the external object and the printed circuit board.

* * * * *